US005653270A

United States Patent [19]

Burrows

[11] Patent Number: 5,653,270

[45] **Date of Patent: *Aug. 5, 1997**

[54] BOTTLE CAP AND VALVE ASSEMBLY FOR A BOTTLED WATER STATION

[75] Inventor: Bruce D. Burrows, Valencia, Calif.

[73] Assignee: Ebtech Inc., Columbus, Ohio

[ * ] Notice: The term of this patent shall not extend beyond the expiration date of Pat. No. 5,413,152.

[21] Appl. No.: 440,507

[22] Filed: May 8, 1995

Related U.S. Application Data

[63] Continuation of Ser. No. 773,024, Oct. 7, 1991, Pat. No. 5,413,152.

[51] Int. Cl.[6] ..... B65B 1/04; B65B 3/04

[52] U.S. Cl. ..... 141/18; 141/350; 141/353; 141/364; 222/83.5; 222/146.6

[58] Field of Search ..... 141/346–354, 141/357, 360, 363, 364, 283, 285, 286, 288, 18, 21, 291, 297–299, 301, 308; 222/83.5, 146.6; 62/389

[56] References Cited

U.S. PATENT DOCUMENTS

| | | | |
|---|---|---|---|
| 1,228,836 | 6/1917 | Schulse | 222/185 |
| 1,319,376 | 10/1919 | Cooper | 222/185 |
| 3,892,235 | 7/1975 | Van Amerongen et al. | 128/200.16 |
| 4,699,188 | 10/1987 | Baker et al. | 141/18 |
| 4,793,514 | 12/1988 | Sheets | 222/67 |
| 4,874,023 | 10/1989 | Ulm | 141/346 |
| 4,991,635 | 2/1991 | Ulm | 141/346 |
| 5,289,855 | 3/1994 | Baker et al. | 141/18 |
| 5,413,152 | 5/1995 | Burrows | 141/18 |

*Primary Examiner*—Henry J. Recla
*Assistant Examiner*—Steven O. Douglas
*Attorney, Agent, or Firm*—Kelly Bauersfeld & Lowry

[57] ABSTRACT

An improved bottle cap and valve assembly are provided in a bottled water station, wherein the station includes an actuator probe for engaging a bottle cap on an inverted water bottle installed onto the bottled water station. The actuator probe includes a probe head for opening a bottle cap valve member, thereby permitting downward water flow from the bottle. Dual flow paths formed through the actuator probe permit smooth downward water flow through one flow path, substantially without glugging, to an underlying station reservoir simultaneously with upward air flow through the other flow path from the reservoir to the bottle interior. In the preferred form, the valve member is integrally molded as part of the bottle cap and configured to be severed therefrom upon engagement with the probe head. The preferred probe head captures and retains the severed valve member in a position for slide-fit sealing re-engagement with the bottle cap when the bottle is removed from the station.

5 Claims, 7 Drawing Sheets

BOTTLE CAP AND VALVE ASSEMBLY FOR A BOTTLED WATER STATION

This is a continuation of application Ser. No. 07/773,024, now U.S. Pat. No. 5,413,152, filed Oct. 7, 1991.

BACKGROUND OF THE INVENTION

This invention relates generally to bottled water stations of the type adapted to receive and support a water bottle in an inverted position, and to selectively dispense water therefrom. More particularly, this invention relates to an improved bottle cap and valve assembly designed for contamination-free delivery of water from a water bottle to an underlying station reservoir, wherein the water delivery occurs smoothly and substantially without glugging to minimize or eliminate bottle fatigue associated therewith.

Bottled water dispenser stations are well-known in the art for containing a supply of relatively purified water in a convenient manner and location ready for substantially immediate dispensing and use. Such bottled water stations commonly include an upwardly open water reservoir mounted within a station housing and adapted to receive and support an inverted water bottle of typically three to five gallon capacity. Water within the inverted bottle flows downwardly into the station reservoir for selective dispensing therefrom through a faucet valve on the front of the station housing. Such bottled water stations are widely used to provide a clean and safe source of water for drinking and cooking, especially in areas where the local water supply contains or is suspected to contain undesired levels of contaminants.

In bottled water stations of the above-described type, the water bottle is normally provided in a clean and preferably sterile condition with an appropriate sealing cap to prevent contamination of the water contained therein. When an inverted bottle on a station housing reaches an empty condition, the empty bottle can be lifted quickly and easily from the station housing and replaced by a filled bottle having the sealing cap removed therefrom. The empty bottle can then be returned to a bottled water vendor for cleaning and refilling.

While bottled water stations are widely used to provide a clean and safe supply of fresh water, undesired contamination of the bottled water can sometimes occur. For example, exterior surfaces of a bottle cap and the associated bottle neck can contact dirt and/or other contaminants in the course of bottle handling and storage prior to use. Removal of the bottle cap followed by installation of the bottle in an inverted position onto a station housing is frequently accompanied by a portion of the water contacting exterior surfaces of the bottle neck. Moreover, when the bottle is installed onto the station housing, at least a portion of the bottle neck is normally immersed within the water contained within the station reservoir. As a result, the potential exists for washing dirt and other contaminants from the exterior of the bottle neck into the station reservoir, thereby contaminating the bottled water supply.

In the past, a variety of valve arrangements have been proposed in an effort to prevent contamination in a bottled water station. Such valve arrangements have typically envisioned a moveable valve member as part of a bottle cap, wherein the valve member is opened in the course of installing the water bottle onto the station housing. See, for example, U.S. Pat. Nos. 4,699,188; 4,874,023; and 4,991,635. However, these devices have not completely prevented small quantities of the water from contacting external bottle neck surfaces, particularly when a bottle is removed from the station housing in a partially filled condition. Moreover, these proposed prior art valve arrangements have not adequately provided for reclosure of the bottle cap upon bottle removal in a partially filled condition, or have otherwise provided closable bottle caps having complex constructions which are both difficult and costly to produce.

Another problem encountered in bottled water stations involves bottle failure as a result of mechanical fatigue attributable to significant and rapid pressure fluctuations during downward water flow to the station reservoir. More particularly, the downward water flow from the bottle is characterized by a substantial glugging or gurgling action as water flowing downwardly from the bottle is exchanged with air passing upwardly from the station reservoir into the bottle interior. That is, a surge of water flows by gravity from the bottle until a sufficient negative pressure is created within the bottle interior, at which time water flow is briefly interrupted by an upward surge of air from the station reservoir. This alternating water and air flow surge action is the result of significant pressure variations within the bottle interior and subjects the bottle structure to significant mechanical fatigue. With modern plastic water bottles, the mechanical fatigue is visually and audibly apparent as the bottle bottom flexes back-and-forth during the glugging action. Unfortunately, the bottom of a plastic bottle is particularly subject to failure since it encounters frequent scratches and nicks in the course of normal bottle handling, and thereby includes structurally weakened areas which are susceptible to cracking or splitting during water delivery.

There exists, therefore, a significant need for further improvements in bottled water stations and related dispensing valve apparatus for maintaining a bottled water supply in a substantially clean and sterile condition, and further for dispensing the bottled water to a station reservoir in a smooth and efficient manner with little or no mechanical fatigue applied to the water bottle. The present invention fulfills these needs and provides further related advantages.

SUMMARY OF THE INVENTION

In accordance with the invention, an improved bottle cap and related valve assembly are provided for dispensing water from an inverted water bottle to an underlying reservoir of a bottled water station or the like. The bottle cap and valve assembly are designed for delivering the bottled water substantially without contamination to the station reservoir, and in a smooth flow manner with simultaneous water-air exchange within the bottle to prevent or minimize bottle fatigue.

The bottle cap is adapted to fit over and close the open neck of a water bottle containing a supply of relatively purified water. The bottle cap includes a valve member moveable to an open position upon engagement with an actuator probe on the bottled water station. The actuator probe is configured for slide-fit sealing engagement with the bottle cap prior to movement of the valve member to the open position. When the valve member is in the open position, the bottle cap and actuator probe cooperate to define a sealed flow path for substantially contamination-free passage of water from the bottle interior to an underlying station reservoir.

The actuator probe is formed with dual flow paths communicating between the bottle interior and the underlying station reservoir to accommodate simultaneous water-air exchange within the water bottle as the water supply flows downwardly into the station reservoir. More particularly, the actuator probe defines a primary flow path for downward water flow into the station reservoir, in combination with a secondary flow path for upward air flow from the reservoir into the bottle interior. The lowermost end of the primary water flow path is disposed vertically below the lowermost end of the secondary air flow path, and downward water flow from the bottle continues until the water level within the reservoir closes the lower end of the air flow path to terminate water-air exchange.

In accordance with further aspects of the invention, the valve member is formed as an integrally molded portion of the bottle cap, and is adapted to be forcibly severed from the bottle cap upon engagement with the actuator probe as the associated water bottle is installed onto the station. The actuator probe includes a contoured probe head for capturing and retaining the severed valve member. Upon subsequent removal of the water bottle from the station, the probe supports the valve member in a position for slide-fit sealing re-engagement with the bottle cap. Accordingly, the bottle can be removed from the station in a partially filled condition, with the valve member re-engaged in a sealing manner to prevent water spillage and potential contamination.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings drawings illustrate the invention. In such drawings.

DETAILED DESCRIPTION OF THE PREFERRED EMBODIMENT

Figure 1:
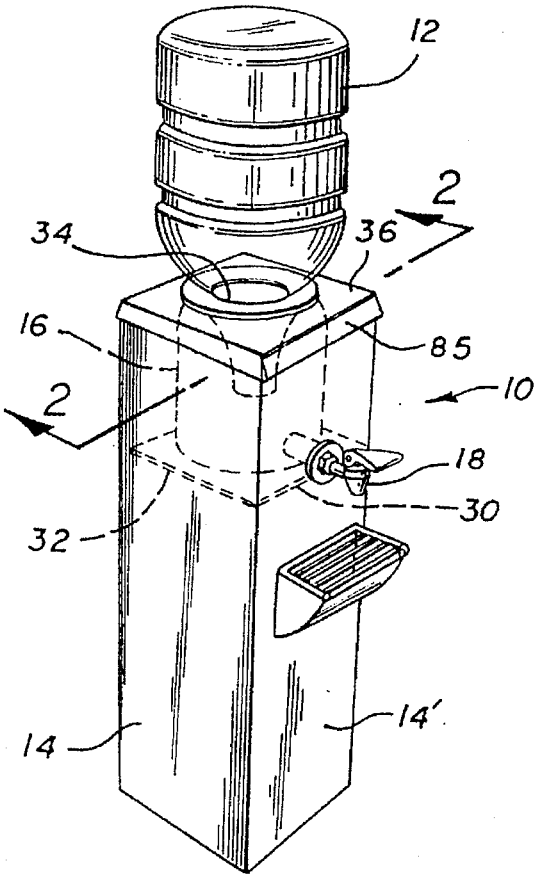
FIG. 1 is a front perspective view illustrating a bottled water station adapted to include the bottle cap and valve assembly embodying the novel features of the invention.

As shown in the exemplary drawings, an improved bottle cap and related valve assembly provided for use in a bottled water station are referred to generally in FIG. 1 by the reference numeral 10. The cap and valve assembly include interengageable components (not shown in FIG. 1) mounted on a water bottle 12 and a station housing 14 to substantially eliminate possibility of water contamination upon drain passage of water from the interior of the water bottle to a station reservoir 16. In addition, the valve assembly is designed to provide a smooth and substantially continuous downward water flow into the station reservoir 16, with simultaneous upward air passage into the water bottle 12, to minimize or eliminate substantial pressure fluctuations within the water bottle and thereby minimize or eliminate mechanical fatigue associated therewith.

The illustrative bottled water station 10 has a generally conventional overall size and shape to include the upstanding station housing 14 to support the water bottle 12 in an inverted orientation such that water contained within the bottle will flow downwardly by gravity into the station reservoir 16. As is known in the art, this downward water flow from the bottle 12 will continue until the station reservoir 16 reaches a substantially filled condition, at which time the water level within the reservoir 16 effectively shuts off further downward water flow from the bottle. A spigot or faucet valve 18 or the like is mounted in an accessible position on a front panel of the station housing 14 and may be conveniently operated to dispense water from the station reservoir. Such dispensing lowers the water level within the reservoir 16, resulting in a subsequent replenish flow of water from the bottle 12.

Although the bottled water station 10 depicted in FIG. 1 includes a single faucet valve 18 for water dispensing purposes, it will be understood that the improved cap and valve assembly of the present invention may be used in other type of bottled water stations. For example, it will be understood that the invention is applicable to bottled water stations having multiple faucet valves for dispensing water maintained at different temperatures within multiple station reservoirs, or within different zones of a single reservoir.

Figure 3:
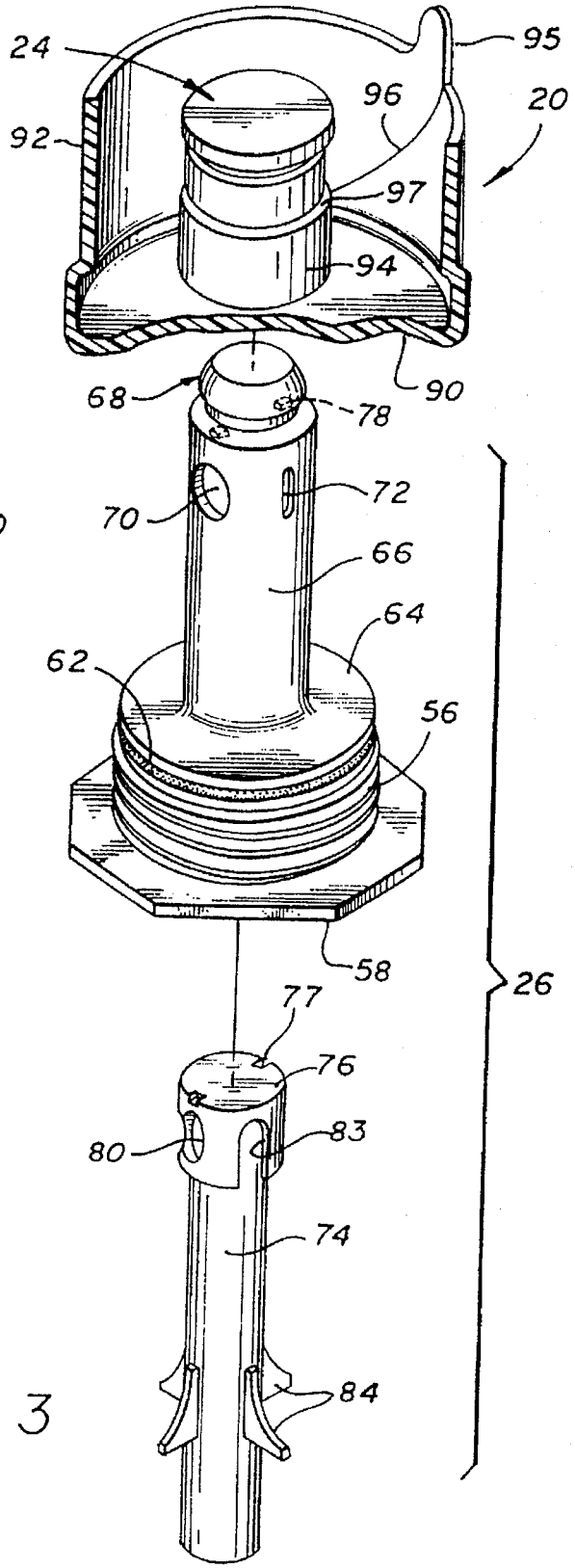
FIG. 3 is a further enlarged and exploded perspective view illustrating a bottle cap in combination with an actuator probe for mounting into the bottled water station.
Figure 2:
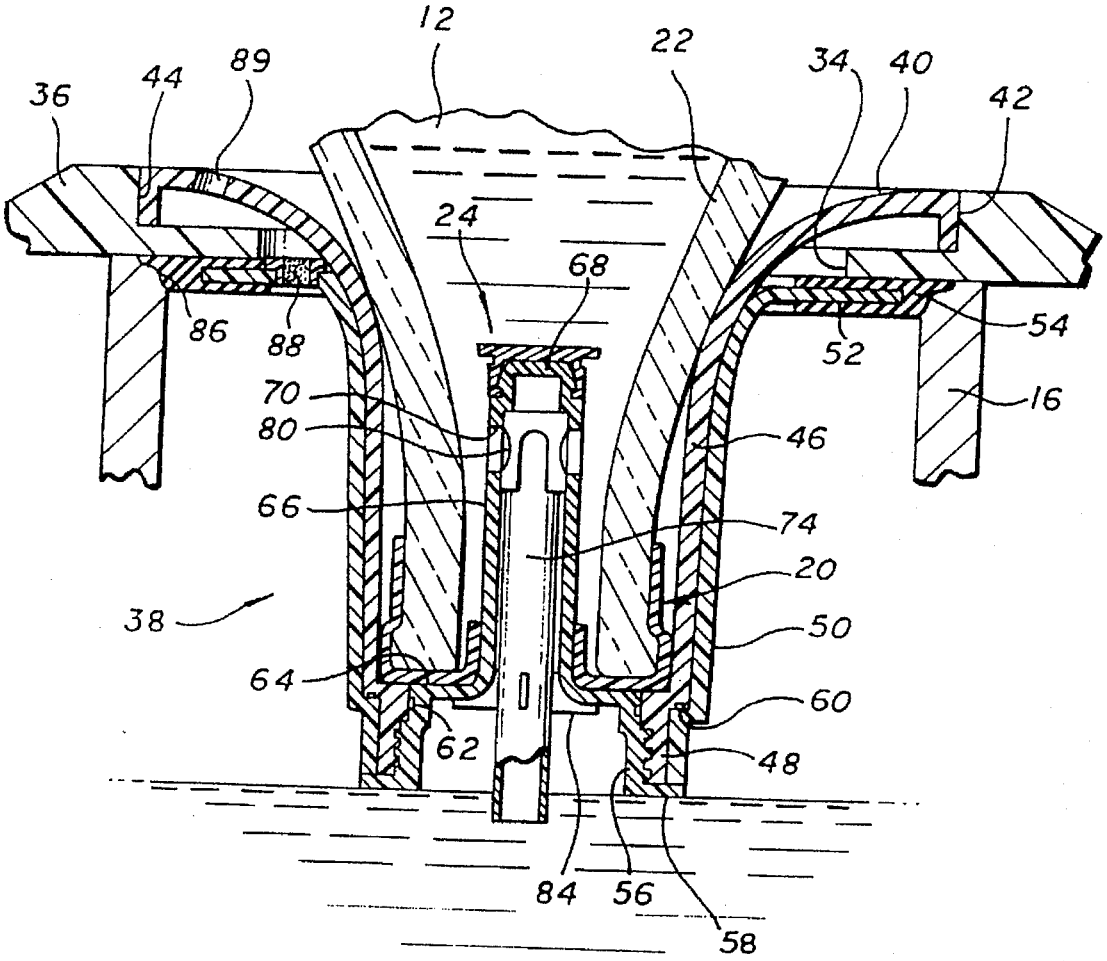
FIG. 2 is an enlarged fragmented vertical sectional view taken generally on the line 2—2 of FIG. 1.

In accordance with the present invention, and as depicted generally in FIGS. 2 and 3, a bottle cap 20 formed typically from a lightweight molded plastic or the like is provided for closing and sealing the otherwise open neck 22 of the water bottle 12 to maintain the bottle contents in a clean and sanitary condition. A valve member 24 is provided as part of the bottle cap 20, and is adapted for engagement with an actuator probe 26 on the station housing 14 to open the water bottle for downward water flow as an incident to bottle installation onto the station 10. The arrangement of the valve member 24 and the actuator probe 26 substantially prevents any portion of the contained water within the bottle 12 from flowing against or otherwise contacting external bottle and/or station housing surfaces subject to potential contamination. In addition, the actuator probe 26 provides dual flow paths for simultaneous and separate flow of water and air in opposite direction s between the bottle interior and the station reservoir 16.

As shown in FIG. 1, the station housing 14 has an upstanding generally rectangular configuration to include a front wall or panel 14' with the faucet valve 18 protruding therefrom. The faucet valve 18 is connected via a short conduit 30 to the lower end of the water reservoir 16 supported on a platform 32 or other similar support structure within the station housing. The reservoir 16 has a generally cylindrical, upwardly open shape which is exposed through a central aperture 34 in a housing cover plate 36 (FIG. 2) to receive water flowing by gravity from the inverted water bottle 12.

With reference to FIG. 2, a receiver assembly 38 is carried by the housing cover plate 36 at the upper end of the reservoir 16 for receiving and supporting the water bottle 12 in an inverted orientation. As shown, the receiver assembly comprises a support funnel 40 having a depending outer flange 42 at an expanded upper end for substantially flush-seat reception into a recess 44 formed in the cover plate 36 about the central aperture 34. From the flange 42, the support funnel 40 extends radially inwardly with a smoothly contoured geometry to merge with a lower cylindrical segment 46 which projects downwardly below the cover plate. A lower end of the cylindrical segment 46 is joined to an internally threaded lower fitting 48.

A sealing sleeve 50 has a generally cylindrical shape adapted for relatively close slide-fit reception onto the support funnel 40 at a position beneath the cover plate 36. More specifically, the sealing sleeve 50 has an outwardly radiating upper rim 52 carrying an annular resilient seal member 54 at a position engaging the underside of the cover plate 36.

From this upper rim 52, the sealing sleeve 50 extends radially inwardly toward the support funnel and then downwardly with a generally cylindrical shape fitted matingly about the cylindrical segment 46 of the support funnel. An externally threaded lock collar 56 is installed into the lower fitting 48 of the support funnel 40, wherein this lock collar 56 has a radially enlarged lower flange 58 for retaining the sealing sleeve 50 with its seal member 54 in binding engagement with the underside of the cover plate 36. A seal ring 60 is conveniently captured between mating shoulders on the support funnel 40 and the sealing sleeve 50 to ensure sealed connection therebetween. In addition, a second seal ring 62 is carried about an upper portion of the lock collar 56 for sealed engagement within the lower fitting 48 of the support funnel.

The lock collar 56 is constructed as an integral portion of the actuator probe 26 for engaging the bottle cap valve member 24, as will be described in more detail. In this regard, as shown in FIGS. 2 and 3, the lock collar 56 is joined at its upper end to a generally horizontally extending annular support base 64 which is joined in turn to a hollow upstanding probe tube 66. The upper end of the probe tube 66 includes a contoured probe head 68 disposed a short distance above a pair of relatively large water flow ports 70 and a comparatively smaller pair of air vent slots 72. Conveniently, the lock collar 56 and probe tube 66 with the probe head 68 thereon may be formed as a one-piece plastic molded component.

The actuator probe 26 additionally includes an insert tube 74 which also may be conveniently molded from a lightweight plastic or the like as a single structural component. The insert tube 74 includes a slightly enlarged upper cap 76 having appropriate notches 77 formed therein for aligned reception of small keys 78 formed within the probe head 68. Mating interconnection between the notches and keys 77 and 78 orients the cap 76 with relatively large water flow ports 80 in alignment with the corresponding water flow ports 70 in the probe tube 66. As a result, water passing downwardly from the water bottle 12 may flow through the aligned water flow ports 70, 80 into the hollow interior (FIG. 2) of the insert tube 74 for further downward passage to the station reservoir 16. Importantly, it will be noted that the lowermost end of the insert tube 74 as depicted in FIG. 2 terminates at a position at least slightly below the lowermost end of the lock collar 56.

The diametric size of the insert tube 74 below the upper cap 76 is somewhat less than the internal diameter of the probe tube 66, thereby providing an annular air flow path 82 between the tubes 66 and 74. Slotted recesses 83 in the cap 76 align with the air slots 72 in the probe tube 66 to permit air flow from the flow path 82 to the slots 72. Spacer wings 84 are provided about a lower region of the insert tube 74 for maintaining the insert tube in general clearance relation with the probe tube 66. With this construction, air flow is permitted from the interior of the lock collar 66 through the air flow path 82 in an upward direction for flow further through the air vent slots 72 to the bottle interior. This air flow passage is permitted simultaneously with water downflow through the insert tube 74. Secure interconnection between the probe tube 66 with the cap 76 and spacer wings 84 of the insert tube 74 can be achieved by a press-fit connection, or through the use of sonic welding or a selected adhesive.

As viewed in FIG. 2, the receiver assembly 38 including the support funnel 40 with sealing sleeve 50 and actuator probe 26 mounted thereto can be installed onto the station housing 14 quickly and easily by simple downward press-fit placement. External flanges 85 (FIG. 1) on the cover plate 36 provide convenient and accurate alignment of the receiver assembly 38 with respect to the underlying reservoir 16. As shown in FIG. 2, this simple press-fit installation onto the station housing positions the periphery of the seal member 54 in appropriate pinched sealing engagement with an upper edge 86 of the reservoir 16. Importantly, as is known in the art, the reservoir interior is vented as by means of a porous filter 88 carried by the sealing sleeve rim 52 and a vent port 89 formed near the outer periphery of the support funnel 40.

When the water bottle 12 is installed onto the bottled water station 10, the bottle 12 is inverted to orient the bottle cap 20 in alignment with the upstanding actuator probe 26 disposed within the support funnel 40 of the receiver assembly 38. In this configuration, as viewed in FIG. 6, the water bottle can be lowered over the probe 26 to unseal the bottle cap 20 and permit downward water flow into the station reservoir 16.

Figure 6:
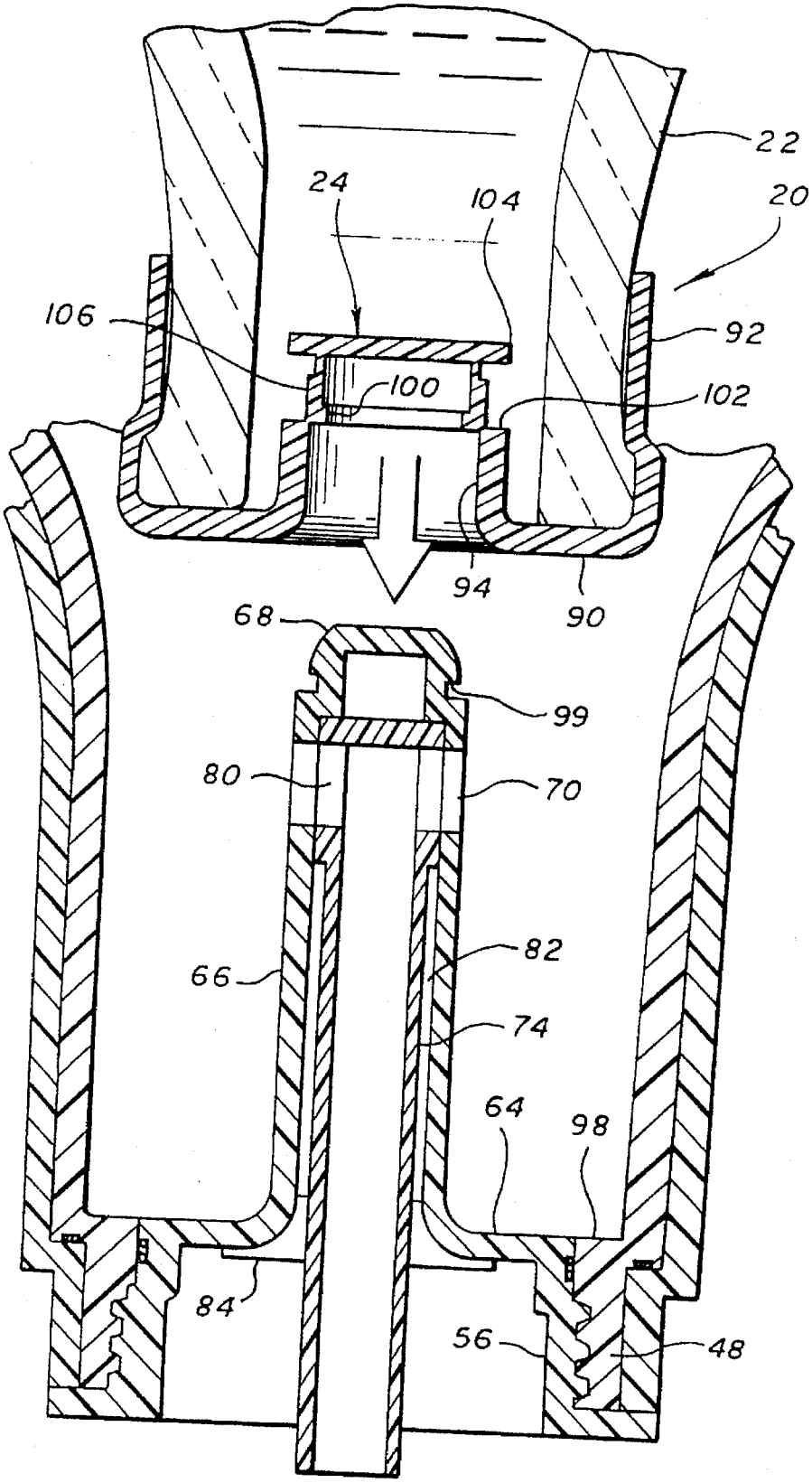
FIG. 6 is an enlarged fragmented sectional view similar to FIG. 4, and illustrating installation of an inverted water bottle onto the underlying actuator probe of the bottled water station.

As shown in FIGS. 2, 3 and 6, the preferred bottle cap comprises a plastic molded component having an annular end plate 90 joined at its outer periphery to a cylindrical outer cap skirt 92, and an inner peripheral margin joined to an inner or central cap sleeve 94. The central cap sleeve 94 protrudes a short distance into the interior of the cap 20 and within the bottle neck 22, terminating at its inboard end in the valve member 24 which can be integrally molded therewith. If desired, a pull tab 95 (FIG. 3) can be provided as an extension of the outer cap skirt 92, in combination with a spiral score line 96 to permit tear-off removal of the cap 20 from the bottle.

When the bottle 12 is installed onto the station housing, the contoured probe head 68 is slidably received into the central cap sleeve 94 with a substantially sealed fit. Further downward motion of the bottle cap 20 over the actuator probe 26 causes the probe head to engage the underside of the valve member 24 and sever the valve member from the cap sleeve 94 at a thin connector ring 97. Still further downward motion displaces the central cap sleeve 94 past the water flow ports 70 and air vents slots 72 on the probe tube 66, such that these openings are communicated with the bottle interior. When the bottle is fully installed or seated onto the station housing, the cap end plate 90 is rested and supported upon a base surface defined by the support base 64 of the lock collar 56 and a horizontally aligned shoulder 98 on the support funnel 40.

Figure 4:
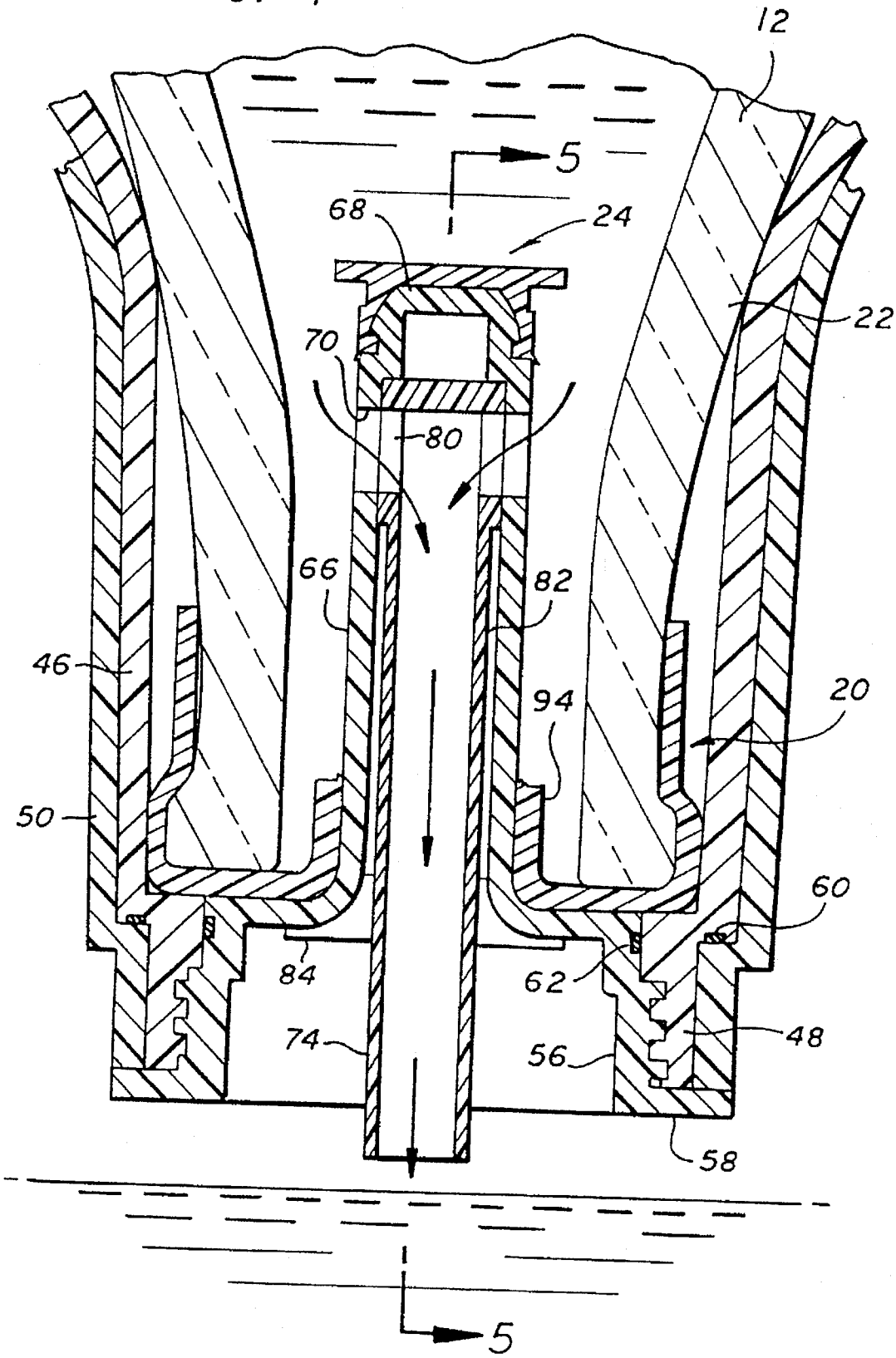
FIG. 4 is an enlarged fragmented sectional view similar to a portion of FIG. 2, and depicting downward water flow from an inverted water bottle through the actuator probe to the bottled water station.
Figure 5:
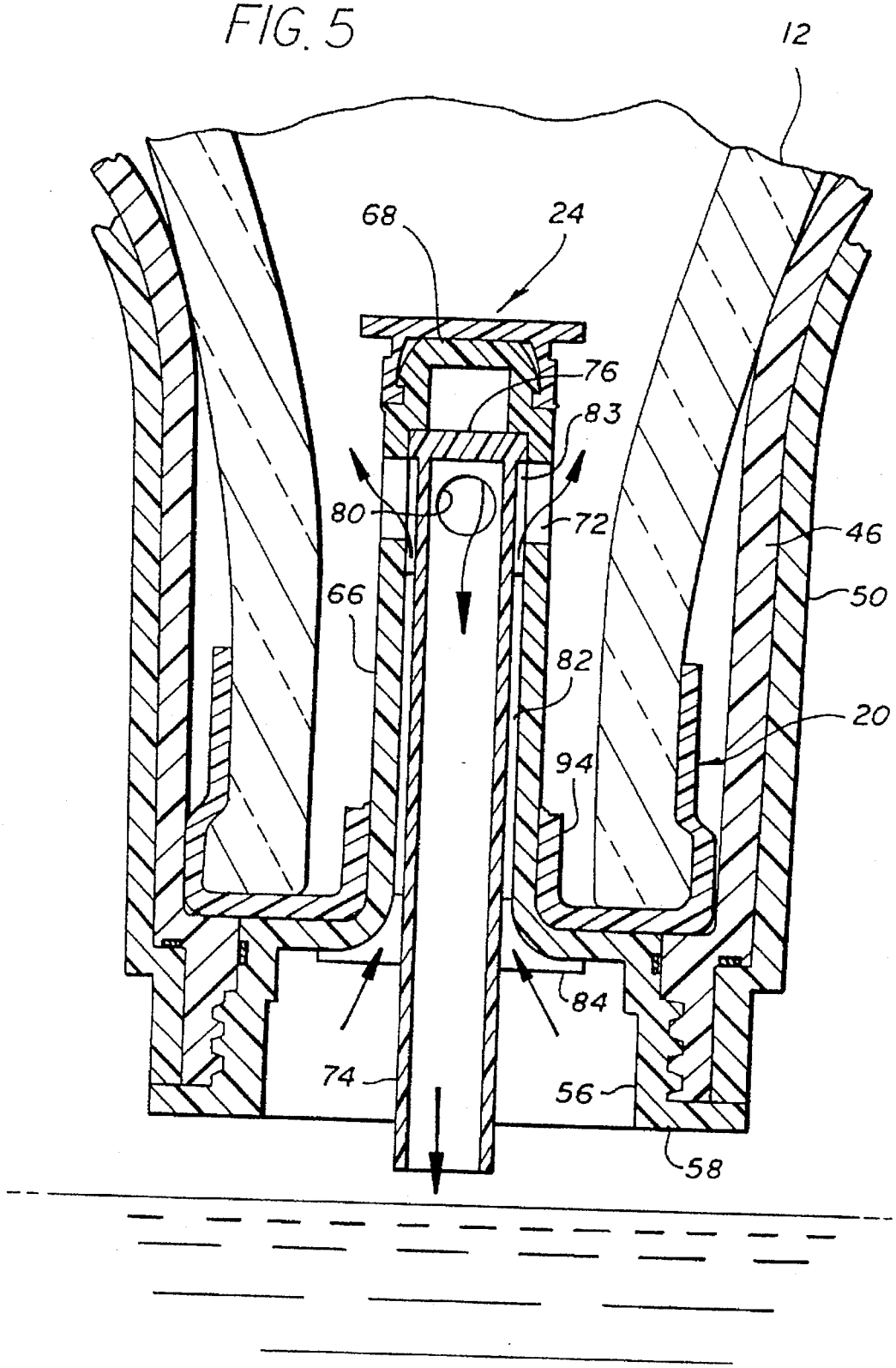
FIG. 5 is a fragmented vertical sectional view taken generally on the line 5—5 of FIG. 4, and illustrating simultaneous water-air exchange between the water bottle and the underlying bottled water station.

When the water bottle 12 is fully installed onto the station reservoir, as shown in FIGS. 2, 4 and 5, downward water flow through the insert tube 74 is permitted to fill the underlying station reservoir 16. This downward water flow proceeds smoothly and substantially continuously until the reservoir 16 is filled, and is accompanied by simultaneous upward air flow exchange through the vent slots 72 to replace the dispensed volume of water. This simultaneous water-air exchange substantially reduces pressure fluctuations within the water bottle, and thereby minimizes or eliminates bottle fatigue attributable thereto. Moreover, in a bottled water station having a reservoir with water maintained at different temperatures within different zones of the reservoir, the simultaneous water-air exchange between the bottle and the reservoir has been found to greatly reduce flow turbulence within the reservoir, such that undesired mixing of water within different temperature zones is substantially reduced.

The downward water flow into the station reservoir continues until the lowermost end of the air vent path 82 is closed by the reservoir water level, as viewed in FIG. 2, when the water level reaches the lowermost extent of the lock collar 56. When this occurs, air exchange from the externally vented reservoir 16 to the bottle interior is closed off to correspondingly halt downward water flow unless and until sufficient water is drawn from the reservoir 16 via the faucet valve 18 to re-establish air vent path communication with the vented upper region of the reservoir.

Figure 7:
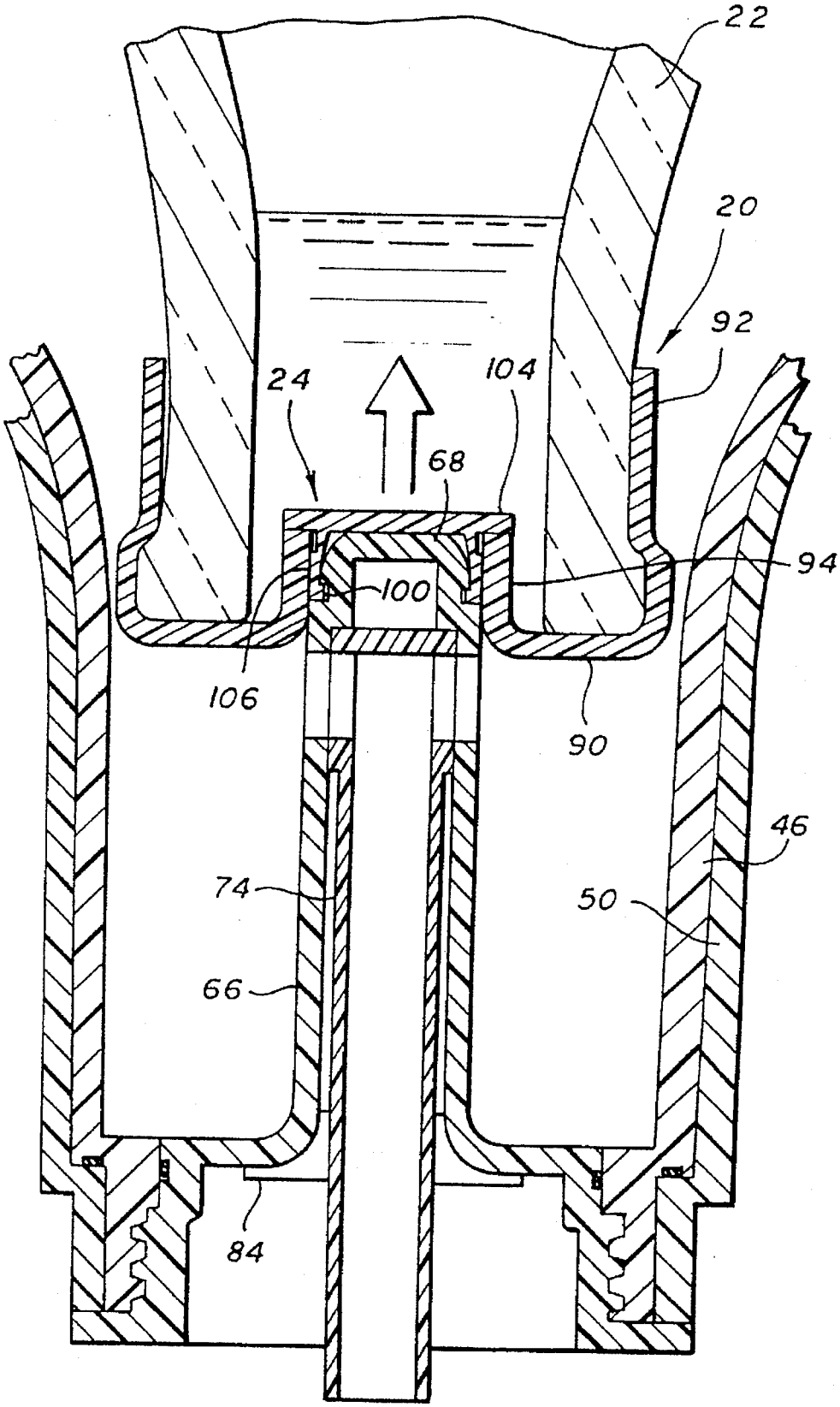
FIG. 7 is an enlarged fragmented sectional view similar to FIG. 6, and illustrating removal of the water bottle from the bottled water station, with sealing re-closure of the bottle cap.
Figure 8:
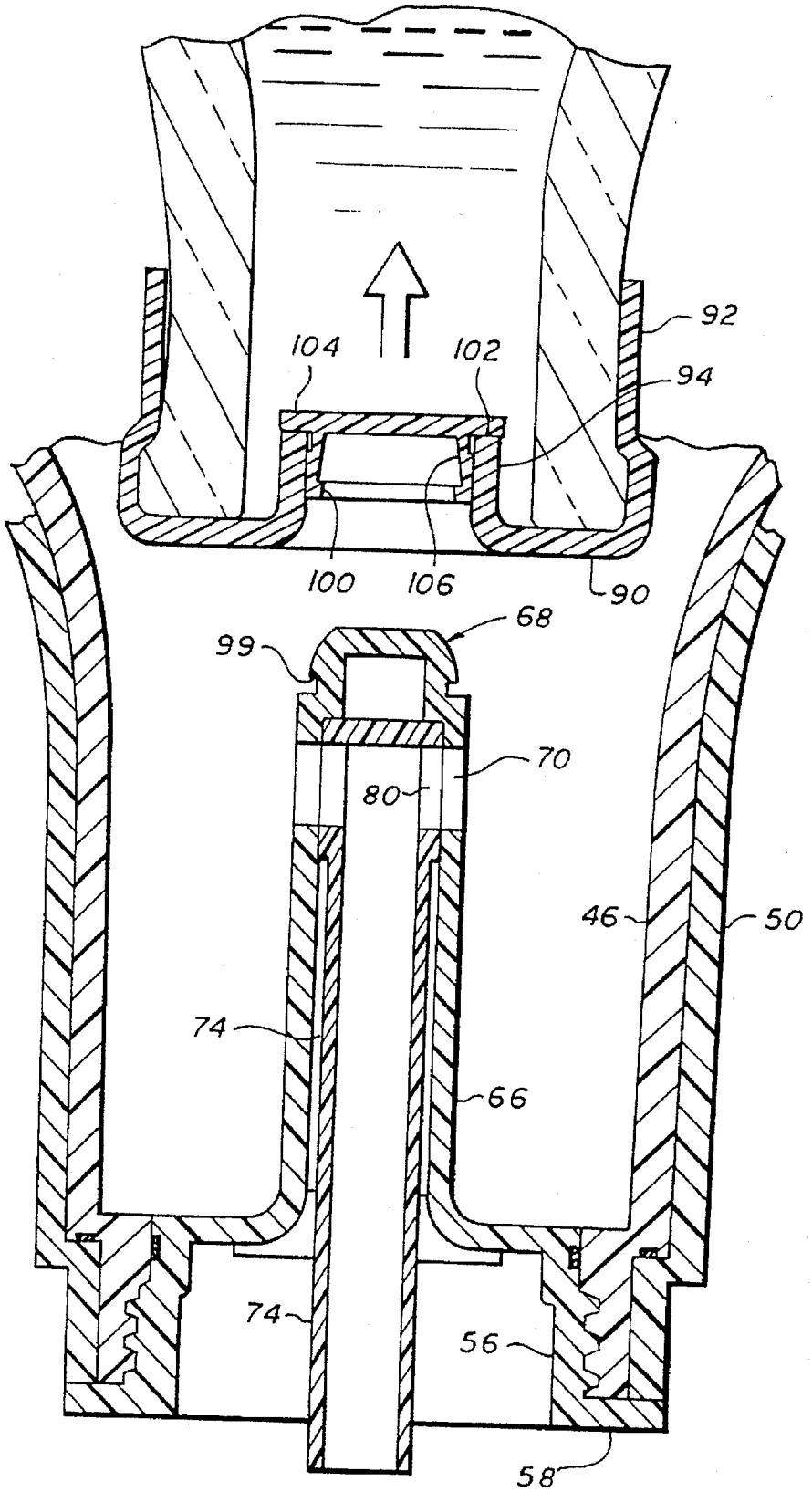
FIG. 8 is an enlarged fragmented sectional view similar to FIG. 7, and illustrating separation of the re-sealed water bottle from the actuator probe.

According to further aspects of the invention, as viewed in FIGS. 7 and 8, the bottle 12 can be removed quickly and easily from the station reservoir, either in an empty or partially filled condition. Upon such removal, the valve member 24 is drawn by the probe head 68 into re-sealing engagement with the bottle cap 20, thereby preventing undesired water spillage or contamination.

More particularly, as viewed in FIGS. 4 and 5, the probe head 68 is contoured to capture and retain the valve member 24 in the opened position while the bottle is fully installed and seated on the station 10. In this regard, the external periphery of the probe head 68 has a barbed edge 99 for gripping engagement past an inner annular rim 100 formed within the valve member 24. This gripping interengagement between the probe head and valve member causes the probe head to capture and retain the valve member in the open position. Upon subsequent bottle removal from the station by lifting the bottle upwardly from the receiver assembly 38, as viewed in FIG. 7, the probe head 68 holds the valve member 24 in a position for re-engagement with the bottle cap 20. Such re-engagement occurs as an inboard annular edge 102 of the central cap sleeve 94 contacts an outwardly extending peripheral edge 104 of the valve member to forcibly lift the valve member from the probe head 68. Further lifting motion separates the valve member from the valve head, while forcing a cylindrical sealing segment 106 of the valve member into the central cap sleeve 94 to maintain the bottle in a closed and sealed condition (FIG. 8).

The improved cap and valve assembly of the present invention thus substantially prevents any water contamination as a water bottle is installed upon or removed from a bottled water station. When the bottle is installed onto the station, the dual flow paths through the actuator probe substantially prevent glugging action and accompanying substantial pressure fluctuations which can otherwise result in bottle fatigue and failure.

A variety of further modifications and improvements to the improved cap and valve assembly of the present invention will be apparent to those skilled in the art. Accordingly, no limitation on the invention is intended by way of the foregoing description and accompanying drawings, except as set forth in the appended claims.

What is claimed is:

1. A bottle cap and valve assembly for a bottled water station, comprising:

a bottle cap for mounting onto a water bottle, said bottle cap including central cap sleeve with a valve member therein;

a vented water reservoir; and a receiver assembly on said reservoir and including means for receiving and supporting a water bottle in an inverted orientation with said bottle cap thereon;

said receiver assembly including an actuator probe for engaging said bottle cap with a sealed fit within said central cap sleeve and for displacing said valve member to an open position relative to said central cap sleeve when the bottle with said cap thereon is received by said receiver assembly;

said actuator probe defining a first flow path for water flow passage from the bottle to said reservoir, and a second flow path for substantially simultaneous air flow passage from said reservoir into the bottle, said first flow path having a lowermost end disposed at least slightly below a lowermost end of said second flow path.

2. The bottle cap and valve assembly of claim 1 wherein said second flow path has a lowermost end disposed within an upper region of said reservoir in a position to be covered and closed by water within said reservoir when the reservoir water level rises to a substantially filled condition, and to be uncovered and exposed when the reservoir water level falls below the substantially filled condition, whereby air flow passage from said reservoir and through said second flow path into the bottle is interrupted by the water within said reservoir when the reservoir water level rises to the substantially filled condition to correspondingly halt downward flow of water from the bottle and through said first flow path to said reservoir, and further whereby air flow passage from said reservoir and through said second flow path into the bottle is resumed when the reservoir water level falls below the substantially filled condition to correspondingly permit resumed downward water flow from the bottle and through said first flow path to said reservoir.

3. A bottled water station comprising:

an upwardly open and vented water reservoir;

support means for receiving and supporting a water bottle in an inverted orientation for drain flow passage of water from the bottle;

means for mounting said support means over the reservoir whereby water draining from the bottle flows into the reservoir; and an actuator probe mounted on said support means, said probe having a size and shape to extend a short distance into the interior of the bottle supported by said support means, said probe defining first and second flow paths for substantially simultaneous and separate exchange respectively of water and air between the reservoir and the bottle, said first flow path having a lowermost end disposed at least slightly below a lowermost end of said second flow path.

4. The receiver assembly of claim 3 wherein said second flow path has a lowermost end disposed within an upper region of said reservoir in a position to be covered and closed by water within said reservoir when the reservoir water level rises to a substantially filled condition, and to be uncovered and exposed when the reservoir water level falls below the substantially filled condition.

5. The receiver assembly of claim 3 further includes means for sealing engagement between said receiver assembly and the bottle to confine fluid flow between the bottle and the reservoir to said first and second flow paths.

* * * * *